US005095340A

United States Patent [19]

Mahoney

[11] Patent Number: 5,095,340

[45] Date of Patent: Mar. 10, 1992

[54] METHOD OF CONTROLLING THE OPERATION OF A MAGNETIC BRUSH TONING STATION

[75] Inventor: Gregory P. Mahoney, Fairport, N.Y.

[73] Assignee: Eastman Kodak Company, Rochester, N.Y.

[21] Appl. No.: 578,172

[22] Filed: Sep. 6, 1990

[51] Int. Cl.[5] ..... G03G 15/09

[52] U.S. Cl. ..... 355/251; 118/657; 355/253; 430/122

[58] Field of Search ..... 355/251, 253, 326, 327, 355/252; 118/645, 657, 658; 430/42, 122

[56] References Cited

U.S. PATENT DOCUMENTS

| | | | |
|---|---|---|---|
| 4,053,218 | 10/1977 | Mikolas | 118/658 X |
| 4,267,201 | 5/1981 | Nakahara et al. | 118/658 X |
| 4,422,405 | 12/1983 | Kasahara et al. | 118/658 |
| 4,429,990 | 2/1984 | Tamary | 355/284 |
| 4,473,029 | 9/1984 | Fritz et al. | 118/657 |
| 4,531,832 | 7/1985 | Kroll et al. | 355/253 |
| 4,546,060 | 10/1985 | Miskinis et al. | 118/657 X |
| 4,690,096 | 9/1987 | Hacknauer et al. | 118/657 |
| 4,699,495 | 10/1987 | Hilbert | 355/253 |
| 4,700,659 | 10/1987 | Hirakura et al. | 118/658 X |
| 4,922,302 | 5/1990 | Hill et al. | 355/251 |

FOREIGN PATENT DOCUMENTS

| | | | |
|---|---|---|---|
| 0158657 | 9/1983 | Japan | 355/326 |
| 0131562 | 7/1985 | Japan | 355/327 |

*Primary Examiner*—A. T. Grimley
*Assistant Examiner*—William J. Royer
*Attorney, Agent, or Firm*—Leonard W. Treash, Jr.

[57] ABSTRACT

A toning station having an applicator with a rotatable component and a mixing device directly below it in a chamber are both rotated to tone an electrostatic image. To not tone an electrostatic image that is passing the applicator, the mixing device is not rotated while the rotatable component of the applicator is rotated for a short period of time to clear a developer position adjacent the electrostatic image of developer. A supply of developer in the chamber has a low enough level that when the mixing device is not rotating it does not come under the magnetic influence of the applicator but when the mixing device is rotating it is within such influence.

5 Claims, 2 Drawing Sheets

METHOD OF CONTROLLING THE OPERATION OF A MAGNETIC BRUSH TONING STATION

FIELD OF THE INVENTION

This invention relates to the toning of electrostatic images. It is particularly useful in selectively toning one of a series of electrostatic images with a magnetic brush and not toning others of the series of electrostatic images with the same brush. It is thus particularly usable in conventional color electrophotographic apparatus.

BACKGROUND ART

Present commercial color electrophotographic apparatus forms a series of electrostatic images on an image member, either a drum or a web, and tones the images with different colored toners. The images are then transferred in registration to a receiving sheet at a transfer station to produce a multicolor image.

Conventionally, the image member has been passed past a series of toning stations. The toning station having the color toner to be applied to a particular image is articulated into position in toning relation to that image and the image is toned. Other stations are positioned out of toning relation with that particular image and moved into such toning relation when the image destined to receive that station's particular color passes by. This approach requires articulation of each toning station which is expensive in both power and complexity of equipment. The station itself has to be moved into a position in which it is seated accurately with respect to the electrostatic image each time it moves, all of which can be done, but only with relatively expensive equipment.

U.S. Pat. No. 4,690,096, Hacknauer et al, issued Sept. 1, 1987, and U.S. Pat. No. 4,699,495, Hilbert, issued Oct. 13, 1987, are representative of a number of prior art references that suggest a gating mechanism between a developer delivery portion of a magnetic brush and a developer applicating portion of a magnetic brush to control the flow of such developer and allow the station to be turned on and off by positioning of the gating mechanism. These structures allow the toning stations to be permanently located in a toning position with respect to the image member, which in turn assures critical positioning. In general, the gating structures, although somewhat complex, are less expensive and complicated than articulation devices.

U.S. Pat. Nos. 4,473,029, Fritz et al, issued Sept. 25, 1984; 4,531,832, Kroll et al, issued July 30, 1985; and 4,546,060, Miskinis et al, issued Oct. 8, 1985; disclose a method of toning in which hard magnetic carrier particles and insulative toner particles make up a body of developer which is transported by a rapidly rotating magnetic core around a sleeve and into development position with respect to an electrostatic image. This sleeve can be stationary or rotated in either direction, but the developer flows generally in a direction opposite that of the rotating core. This structure has substantial advantages over traditional magnetic brush structure including extremely high quality development of fine lines and solid areas. The high coercivity of the carrier particles causes them to flip in response to pole transitions created by the rapidly rotating magnetic core which flipping is in a direction that carries them around the sleeve in a direction opposite to that of the moving core. In the toning area, the particles do not brush roughly over the electrostatic image, but instead are continually flipping at such a rapid rate that toning is effected without relative movement between the developer and the image. U.S. Pat. No. 4,922,302, Hill et al, issued May 2, 1990 shows an example of a toning station using this basic approach, which station has been adopted commercially.

STATEMENT OF THE INVENTION

It is an object of the invention to selectively tone or not tone an electrostatic image passing a magnetic brush toning station without articulating the station and without an active gating structure.

This and other objects are accomplished by positioning a mixing device directly below a magnetic brush applicator which applicator has a rotatable component. A supply of developer in a housing around the mixing device has a first level out of the magnetic field of the applicator when the mixing device is not rotated and a second, higher level within the magnetic field of the applicator when the mixing device is rotated. The inventive method includes rotating both the rotatable component of the applicator and the mixing device to continuously make developer of said supply of developer available to the applicator and to transport developer around the applicator into toning relation with an electrostatic image to be toned by the station. The method further includes not rotating the mixing device so that the supply of developer remains at too low a level to be available to the applicator to prevent toning the electrostatic image passing the applicator.

According to a preferred embodiment, the method includes the step of rotating the applicator after stopping rotation of the mixing device at least long enough to remove developer from a space between the image member and the applicator, at the beginning of the step of not rotating.

Using this method, very little additional structure is required to selectively tone images as compared with a structure that automatically tones all images passing it. That is, with an appropriate supply of developer and positioning of the mixing structure with respect to the applicator, elimination of toning is accomplished by controlling the mixing device and the magnetic brush applicator.

This invention has particular application to toning methods described in the Miskinis et al, Fritz et al and Kroll et al patents in which a mixture of hard magnetic carrier particles and insulating toner particles are transported through a toning position by a rapidly rotating magnetic core inside of a non-magnetic sleeve. Such methods transport a relatively small amount of developer at any one time on the applicator which allows quite rapid removal of the developer from the toning position when the mixing device rotation is terminated.

SPECIFIC DESCRIPTION OF THE DRAWINGS

In the detailed description of the preferred embodiment of the invention presented below, reference is made to the accompanying drawings, in which.

SPECIFIC DESCRIPTION OF THE PREFERRED EMBODIMENT

Figure 1:
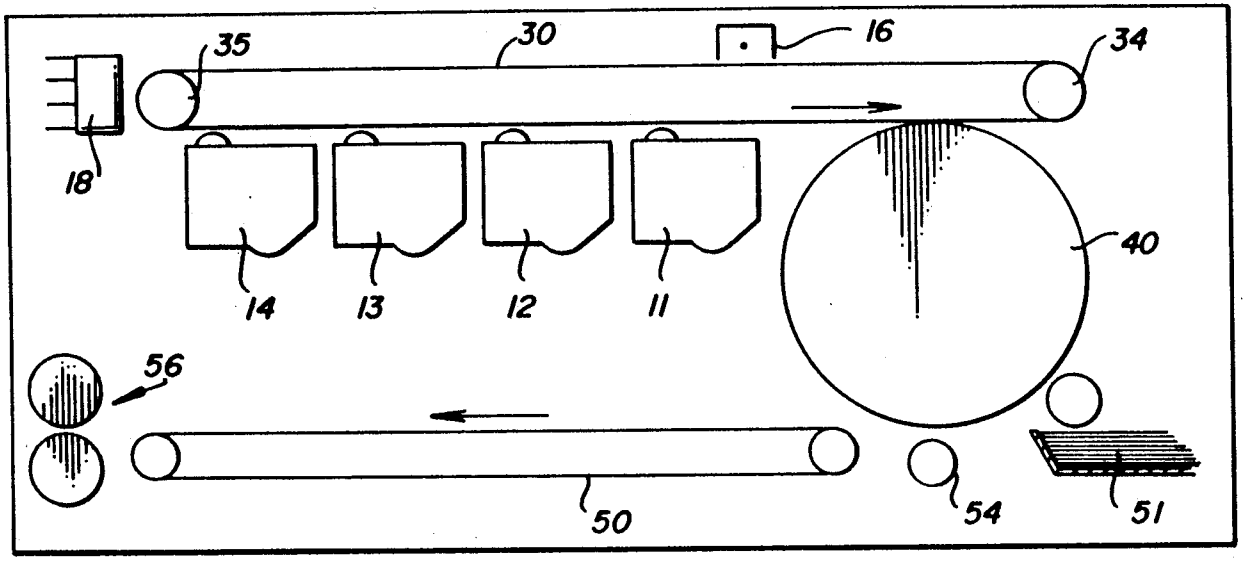
FIG. 1 is a side schematic of a color electrophotographic apparatus in which the invention is usable.

According to FIG. 1 an electrophotographic apparatus for making color prints includes an electrophotographic image member 30 entrained about a pair of rollers 34 and 35. Image member 30, as shown in FIG. 1, is an endless belt and includes at least a photoconductive layer and a conductive backing for forming electrostatic images in response to radiation, as is well known in the art. Image member 30 is uniformly charged by a charging station 16 and is exposed to imagewise radiation at an exposing station 18. Exposing station 18 can be either optical or electronic. As shown in FIG. 1, it is an LED printhead which creates an electrostatic image on image member 30 in response to an electronic signal. Electrostatic images formed by exposure station 18 are toned by one of toning stations 11, 12, 13 or 14 to create toner images according to the color of the station used.

To produce a multicolor image, a series of electrostatic images are formed by exposure station 18 which are toned by different ones of toning stations 11, 12, 13 and 14 to create a series of different color toner images. The toner images are transferred in registration to an intermediate transfer drum 40 to create a multicolor toner image. The multicolor toner image, in turn, is transferred in one step to a receiving sheet from a receiving sheet supply 51 at a transfer station 54. The receiving sheet with the color image is then transported by a transport device 50 to a fuser 56 and hence out of the apparatus into a collection hopper, not shown.

Conventionally, in order to tone each electrostatic image with a different one of toner stations 11, 12, 13 or 14, an electrostatic image passing a toning station not to be used must not be toned by that station. This is accomplished by articulating the unused toning station away from the image member 30. Such articulation is expensive. It further makes continued accurate spacing between the toning station and image member 30 more difficult and costly to accomplish.

Figure 2:
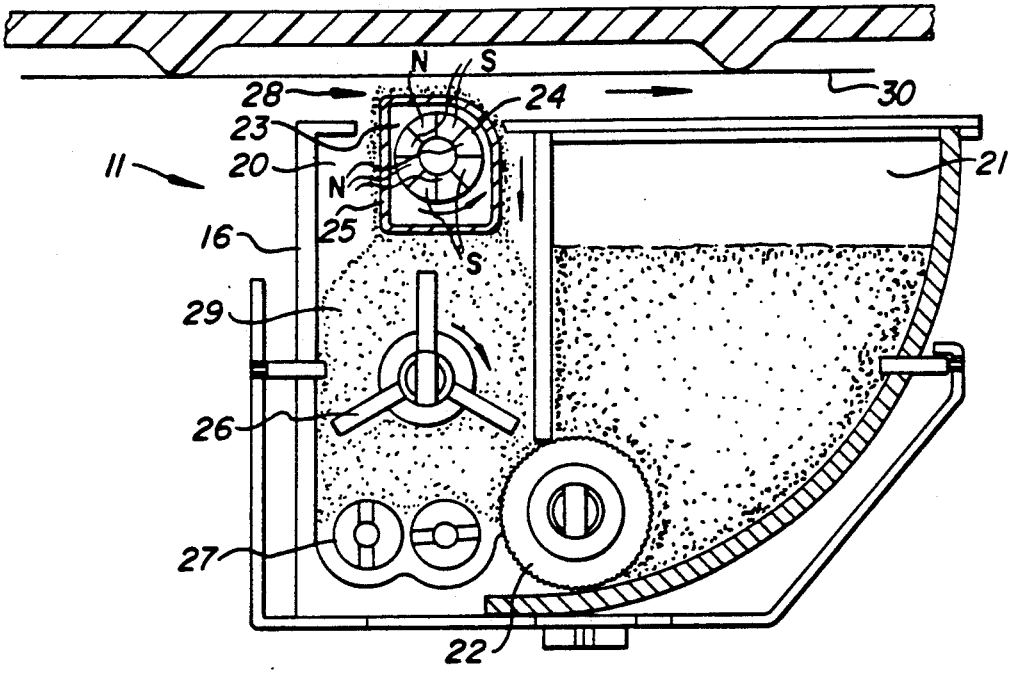
FIGS. 2 and 3 are side schematic sections of a toning station illustrating two different steps in the inventive method.

This problem is solved by a method that is illustrated with reference to FIGS. 2 and 3. According to FIGS. 2 and 3, toning station 11 (and stations 12, 13 and 14) includes a housing 16 which defines first and second chambers 20 and 21 separated by a center wall 49. For a similar toning station, see U.S. Pat. No. 4,922,302, Hill et al, issued May 2, 1990.

Chamber 21 includes a supply predominantly of toner which can be fed into chamber 20 by a toner supply roller 22 in an opening at the base of center wall 49 in response to a signal indicating the need for toner in chamber 20. Chamber 20 includes a supply of developer which is made up of finely-divided hard magnetic carrier particles mixed with insulative toner particles similar to that described in the Miskinis et al patent cited above. At the top of chamber 20 is a magnetic brush applicator 23 which includes a rotatable magnetic core 24 inside a stationery, non-magnetic sleeve 25. Directly below magnetic brush applicator 23 is a mixing device which includes a rotatable paddle 26 and a pair of rotating augers 27. Paddle 26 and augers 27 are geared together to vigorously mix the developer in chamber 20.

Figure 3:
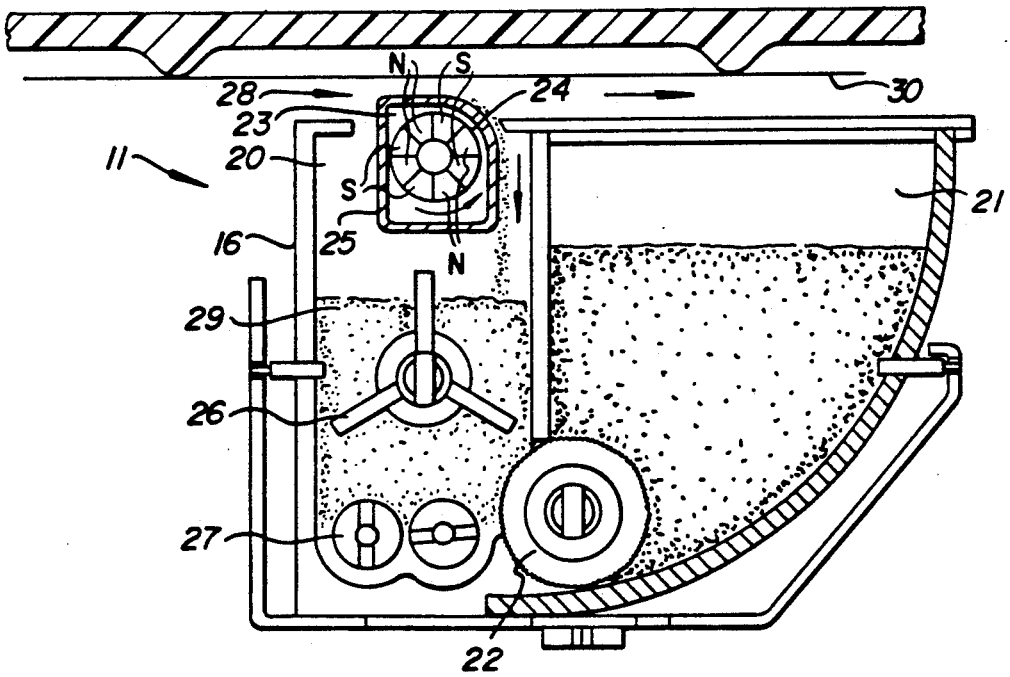

When the mixing device 26 and 27 is not being rotated as shown in FIG. 3, the developer supply 29 settles under gravity to a level substantially below the magnetic influence of magnetic brush applicator 23. When the mixing device is rotating as shown in FIG. 2, the developer supply 29 assumes a much higher level from the agitation of the mixing device and comes under the magnetic influence of magnetic brush applicator 23. With rotatable core 24 rotating in a counterclockwise direction as shown in FIG. 2, developer is transported by that rotation around the outside of sleeve 25 in a clockwise direction. The developer passes through a development zone 28 in which it contacts moving image member 30. The continual changes in the direction of the magnetic field caused by the rotation of core 24 cause continual flipping of the hard magnetic particles of the developer. As described more fully in the Miskinis et al patent, this develops an electrostatic image carried by image member 30 even though there is no relative movement between the developer and the image member 30. That is, the image member 30 and the developer are moving at substantially the same speed and in the same direction. After applying toner to an image, developer with a low toner concentration continues around sleeve 25 and re-enters the supply of developer in chamber 20 for continued mixing. The toner lost in the toning process is replaced by periodic or demand actuation of developer feed roller 22 as is well known in the art.

When a portion of image member 30 passes toning station 11 containing an electrostatic image to be toned by a station different from station 11, for example, to receive toner of a different color, station 11 must be moved to a condition in which it does not tone that image. This is accomplished by not rotating the mixing device 26 and 27, thereby allowing the supply of toner to settle to the level shown in FIG. 3 in which it is out of the influence of applicator 23. Preferably, the rotatable core 24 continues to rotate for sufficient time to return all developer on sleeve 25 to the developer supply in chamber 20 or at least to remove such developer from the toning position 28. If no developer is in the toning position 28 when the electrostatic image passes, that image will not be toned.

Figure 5:
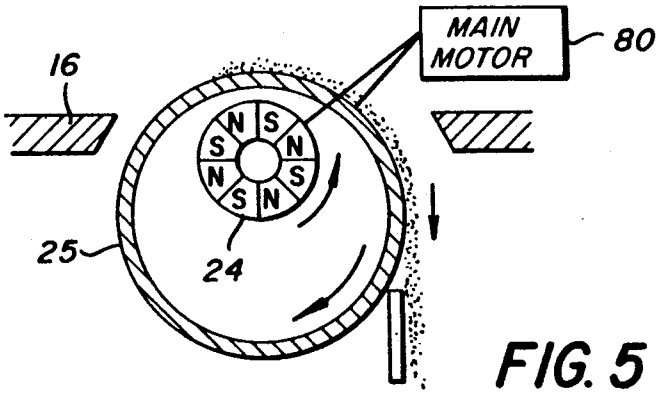
FIG. 5 is a side schematic section of an alternative embodiment of a magnetic brush applicator usable in carrying out the invention.

Ordinarily, clearing the developer from the toning position would require a space on image member 30 between images (interframe) equal to approximately half the circumference of sleeve 25. In the structure shown in FIG. 3, this distance can be made as small as an inch and a half, which is a reasonable interframe for many applications. However, to make the interframe shorter, a variable speed drive can be used to rotate magnetic core 24 with the drive timed to accelerate as the mixing device is turned off. Further, according to FIG. 5, and as disclosed in the Miskinis et al, Fritz et al, and Kroll et al patents, the sleeve 25 can be cylindrical in shape and rotatable independently of the core 24. Such rotation can be either with or against the flow of the developer, but, generally is with the flow of developer to assist in its movement. To increase the speed of the developer as the mixing device is turned off, the sleeve speed can be increased if cocurrent with the flow of developer or reversed if ordinarily rotating against the flow of developer, with or without increasing the speed of the core.

Figure 4:
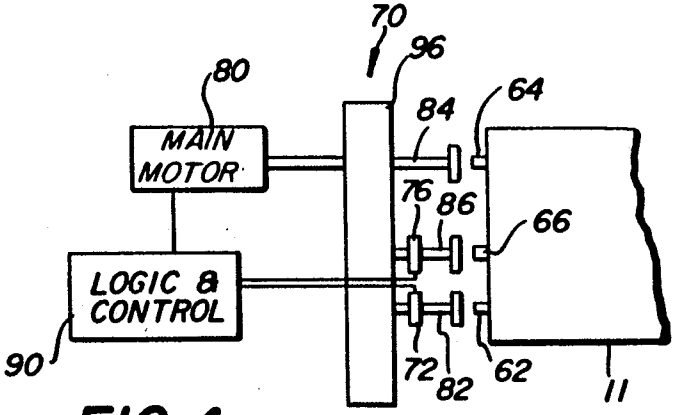
FIG. 4 is a front view, partially schematic, of the toning station shown in FIGS. 2 and 3.

According to FIG. 4, the developer station 11 is shown slightly removed from a drive mechanism 70 which drives its moving components in response to a logic and control 90 for the apparatus. More specifically, magnetic core 24, paddle 26 and toner feed roller 22 have shafts 64, 66 and 62 which are external to station 11 and mate with cooperating drive shafts 84, 86, and 82, respectively. Shafts 84, 86 and 82 emanate from a gear box 96 which derives its power from a main motor 80. Gear box 96 includes appropriate gears to drive magnetic cores 24, paddle 26 and toner feed roller 22 at their desired respective speeds. Clutches 72 and 76 are actuable in response to signals from logic and control 90 and control rotation of shafts 82 and 86 which in turn control rotation of roller 22 and paddle 26. Paddle 26 is connected to augers 27 through gearing that is part of station 11, and is not shown.

Thus, in an ordinary toning process, motor 80 is in a driving condition while clutch 76 is engaged to cause both magnetic core 24 and mixing device 26 and 27 to rotate. Clutch 72 is engaged only in response to a signal from logic and control 90 to add toner. When logic and control 90 determines that the end of an image being toned is being reached, it disengages clutch 76. It also speeds up motor 80 for a short period of time to clear developer from development position 28.

Development station 11 is shown as a disposable station which can be easily inserted and removed from an apparatus as shown in FIG. 4. However, the principle can be used also with a more permanent station in which toner is added to chamber 21 periodically. Note also that chamber 21 can include some magnetic carrier particles to replace magnetic carrier particles that occasionally are lost in the process.

The invention has been described in detail with particular reference to a preferred embodiment thereof, but it will be understood that variations and modifications can be effected within the spirit and scope of the invention as described hereinabove and as defined in the appended claims.

I claim:

1. A method of forming a series of toner images of different color on an image member, said method comprising:

creating a series of electrostatic images on said image member, passing said image member past a plurality of toner stations, at least one of said toner stations including a magnetic brush applicator having a magnetic field and a rotatable component, a rotatable mixing device below said applicator and a supply of developer in a housing around said mixing device, the supply of developer having a first level out of the magnetic field of said applicator when said mixing device is not rotated and a second level within said field when said mixing device is rotated, rotating both the rotatable component of the applicator and the mixing device to continuously make said supply of developer available to said applicator and to transport developer around said applicator into toning relation with an electrostatic image to be toned by said one station, not rotating said mixing device while an electrostatic image is passing said one station so that developer remains at too low a level to be available to said applicator, thereby permitting the electrostatic image to pass the applicator of said station without being toned, and rotating the rotatable component faster at the beginning of the step in which said mixing device is not rotated than it is rotated when said mixing device is being rotated at least long enough to remove developer from toning relation with the image member.

2. A method according to claim 1 wherein said applicator includes both a rotatable non-magnetic sleeve and a rotatable magnetic core, both of which are rotated in said step in which said mixing device is rotated and at least one of which is rotated at the beginning of the step in which said mixing device is not rotated to remove developer from a toning relation with the image member.

3. A method according to claim 2 wherein said sleeve is increased in speed at the beginning of the step in which said mixing device is not rotated.

4. A method according to claim 3 wherein both said sleeve and core are increased in speed at the beginning of the step in which the mixing device is not rotated.

5. A method of selectively toning or not toning an electrostatic image as it passes a magnetic brush applicator without articulating said applicator, said method comprising:

rotating a mixing device located below said applicator to elevate the level of a mixture of a developer supply into the magnetic influence of the applicator while rotating a portion of the applicator to bring developer through a development zone in developing relationship with an electrostatic image, not rotating such a mixing device so that developer remains at too low a level to be available to said applicator to permit an electrostatic image to pass said applicator without being toned, and rotating a portion of the applicator after stopping rotating of the mixing device at a higher speed than that portion is rotated while said mixing device is being rotated at least long enough to remove developer from a space between the image member and the applicator.

* * * * *